US005521325A

United States Patent [19]

Takeuchi et al.

[11] Patent Number: 5,521,325

[45] Date of Patent: May 28, 1996

[54] DEVICE FOR SYNTHESIZING A MUSICAL TONE EMPLOYING RANDOM MODULATION OF A WAVE FORM SIGNAL

[75] Inventors: Chifumi Takeuchi; Toshifumi Kunimoto; Norio Suzuki; Takaaki Muto, all of Hamamatsu, Japan

[73] Assignee: Yamaha Corporation, Hamamatsu, Japan

[21] Appl. No.: 854,295

[22] Filed: Mar. 19, 1992

[30] Foreign Application Priority Data

Mar. 22, 1991 [JP] Japan ..... 3-081106
May 14, 1991 [JP] Japan ..... 3-108018

[51] Int. Cl.[6] ..... G10H 1/04; G10H 7/00

[52] U.S. Cl. ..... 84/624; 84/622; 84/630

[58] Field of Search ..... 84/622, 624, 630, 84/DIG. 26

[56] References Cited

U.S. PATENT DOCUMENTS 4,130,043 12/1978 Niimi ..... 84/DIG. 10 X
4,649,783 3/1987 Strong et al. .
4,785,706 11/1988 Toshifumi .
4,868,869 9/1989 Kramer ..... 84/622 X
4,984,276 1/1991 Smith ..... 84/630
5,113,743 5/1992 Higashi ..... 84/622
5,117,729 6/1992 Kunimoto ..... 84/660
5,131,310 7/1992 Kunimoto ..... 84/622 X
5,157,216 10/1992 Chafe ..... 84/695
5,164,530 11/1992 Iwase ..... 84/624
5,180,877 1/1993 Kunimoto ..... 84/624
5,225,619 7/1993 Sharp ..... 84/622 X
5,254,805 10/1993 Iizuka ..... 84/624 X

*Primary Examiner*—William M. Shoop, Jr.
*Assistant Examiner*—Jeffrey W. Donels
*Attorney, Agent, or Firm*—Graham & James

[57] ABSTRACT

An apparatus for synthesizing a musical tone comprises a loop circuit for circulating an input wave form signal through a delay circuit, a wave form memory, and a random modulation circuit for modulating the wave form signal stored in the wave form memory. The random modulation circuit generates a random signal, such as a noise signal. The random signal modulates address data to the wave form memory, so that the read wave form data read out from the wave form memory is delicately varied with time.

23 Claims, 10 Drawing Sheets

ADRS

| PERN SEL | COUNTER OUTPUT | PERN MEMORY DATA |
|---|---|---|
| 0 | 0 | $N_{00}$ |
| | 1 | $N_{01}$ |
| | 2 | $N_{02}$ |
| | ⋮ | ⋮ |
| 0 | 7 | $N_{07}$ |
| 1 | 0 | $N_{10}$ |
| | 1 | $N_{11}$ |
| | 2 | $N_{12}$ |
| | ⋮ | ⋮ |
| 1 | 7 | $N_{17}$ |

Fig. 6

DEVICE FOR SYNTHESIZING A MUSICAL TONE EMPLOYING RANDOM MODULATION OF A WAVE FORM SIGNAL

BACKGROUND OF THE INVENTION

1. Field of the Invention

The present invention relates to an apparatus for synthesizing a musical tone signal which has a loop circuit. More particularly, the present invention relates to an apparatus for synthesizing a musical tone signal in which a musical tone synthesizing method of a delay feed back type is employed so that, when a wave form signal is inputted into a loop circuit including a delay circuit, a circulated process is performed therein to synthesize a musical tone signal.

2. Prior Art

A digital tone generator including a loop circuit having a delay circuit have been provided in electronic musical instruments for synthesizing musical tone signals. The digital tone generator including the loop circuit is dependent on the so-called musical tone synthesizing algorithm of the delay feed back type in which a specified signal, such as an initial wave form signal, an impulse signal, or a nonlinear signal, is inputted into the loop circuit and a recurrence calculation process is carried out (Japanese patent publication numbers sho 58-58679, 58-48109, 59- 7396, and Laid-open publication numbers sho 62-143097, 63-80300, 63-40199, and the like).

The apparatus of this type is called a physical model tone generator. Because, an actual mechanical or air vibration series is represented physically and approximately by an electronic circuit. For example, the Japanese Patent Laid-open publication number sho 63-40199 discloses the art which includes a loop circuit having a delay element for simulating a string tone. An excitation signal to be outputted to the loop circuit is generated based on a signal from the loop circuit and a signal corresponding to a bow velocity and a bow pressure of a natural string instrument.

However, the above type tone generator requires accurate control of playing information to obtain stable, natural feeling musical tones, because the tone generator is arranged so as to simulate a tone generation principle of the natural string instrument. In addition, the control requires the same technique as the playing of the natural string instrument. Therefore, the control and the playing operation of the electronic musical instrument having the above type tone generator causes complicated control and playing operation.

FIG. 7 shows a conventional musical tone synthesizing series of a model which simulates very much the vibration series of the natural string instrument. In this strict model, it is difficult to obtain any desired tone pitch. A pitch frequency depends on the reciprocal of the sum of the delay amount of two delay circuits 21*a*, 21*b* and two filters 22*a*, 22*b*. But the accurate value of the pitch frequency isn't seen unless the musical tone is actually synthesized. The actual pitch frequency is often slightly lower than that which the above mentioned linear series decides. Also, in this accurate model, a strange musical tone is often generated, and the musical tone isn't outputted at all with an audio frequency though that has to be outputted under a certain condition. This way, the pure physical model of the musical tone synthesizing series has a problem that the control is very difficult. The way of modifying the loop circuit configuration or limiting input signals, such as the signals corresponding to the bow velocity and the bow pressure, within a specified range is capable of causing easy control and playing operation. However, the outputted musical tone is far from the natural one and tone color varying is monotonous, and therefore it is impossible to obtain natural feeling musical tones continuously.

Still more, if a memory device is provided to store as much wave form data as the natural instrument generates, a very large memory device is required.

SUMMARY OF THE INVENTION

It is therefore an object of the present invention to provide an apparatus for synthesizing musical tones which allows control to be easy.

It is another object of the present invention to provide an improved apparatus for synthesizing musical tones which allows the musical tones to be stable and bring more natural feeling.

It is still another object of the present invention to provide an apparatus for synthesizing musical tones which allows the amount of memory consumption to be decreased very much.

In accordance with the present invention, an apparatus for synthesizing a musical tone signal comprises a loop circuit for circulating an input wave form signal through a delay circuit, a wave form generator such as a wave form memory, and a random modulation circuit for modulating the wave form signal generated by the wave form generator.

FIG. 1 is a schematic diagram of the present invention. The random modulation circuit comprises a noise generator 3 and a modulation controller 4. In this diagram, an excitation wave form generated by a wave form generator 1 is modulated by noises, and the modulated excitation wave form is inputted into a loop circuit 2 including a delay circuit 21. Amplitude modulation, frequency modulation, phrase modulation or combination of them can be employed in the modulation control means. The noise can be any one of noises having various frequency characteristics, such as white noise, pink noise and modified noise obtained by filtering them. Also, the frequency characteristic can be variable with any parameter or with passage of time. Furthermore, the modulation method, the modulation degree or the excitation wave form can be controlled or switched by musical-tone-designation-information, such as pitch or tone color information, generated by musical-tone-designation-information generator 5.

The wave form signal generated by the wave form generator 1 is imparted into the loop circuit 2 as the excitation signal, so that this configuration allows control to be stable and easy. In addition, the wave form signal is modulated by the noise, so that this configuration allows the outputted musical tone to be more natural and varied. That is, this configuration enables the control to be stable and easy without failure of essential tone quality that the physical model tone generator has.

In accordance with the present invention, another apparatus for synthesizing musical tones is organized as shown in FIG. 2 so that the excitation wave form generated by the wave form generator 1 is switched according to specified wave-form-switch-information generated by wave-form-switch-information generator 6. Therefore, a tone color can be varied with time, and a musical tone varying with time such as an attack portion tone can be reproduced. That is, this configuration enables the output musical tones to be varied and generated successively with more natural feeling.

BRIEF DESCRIPTION OF THE DRAWINGS

FIG. 6 shows a format of a PERN memory 103.

DETAILED DESCRIPTION OF THE PREFERRED EMBODIMENTS

Figure 1:
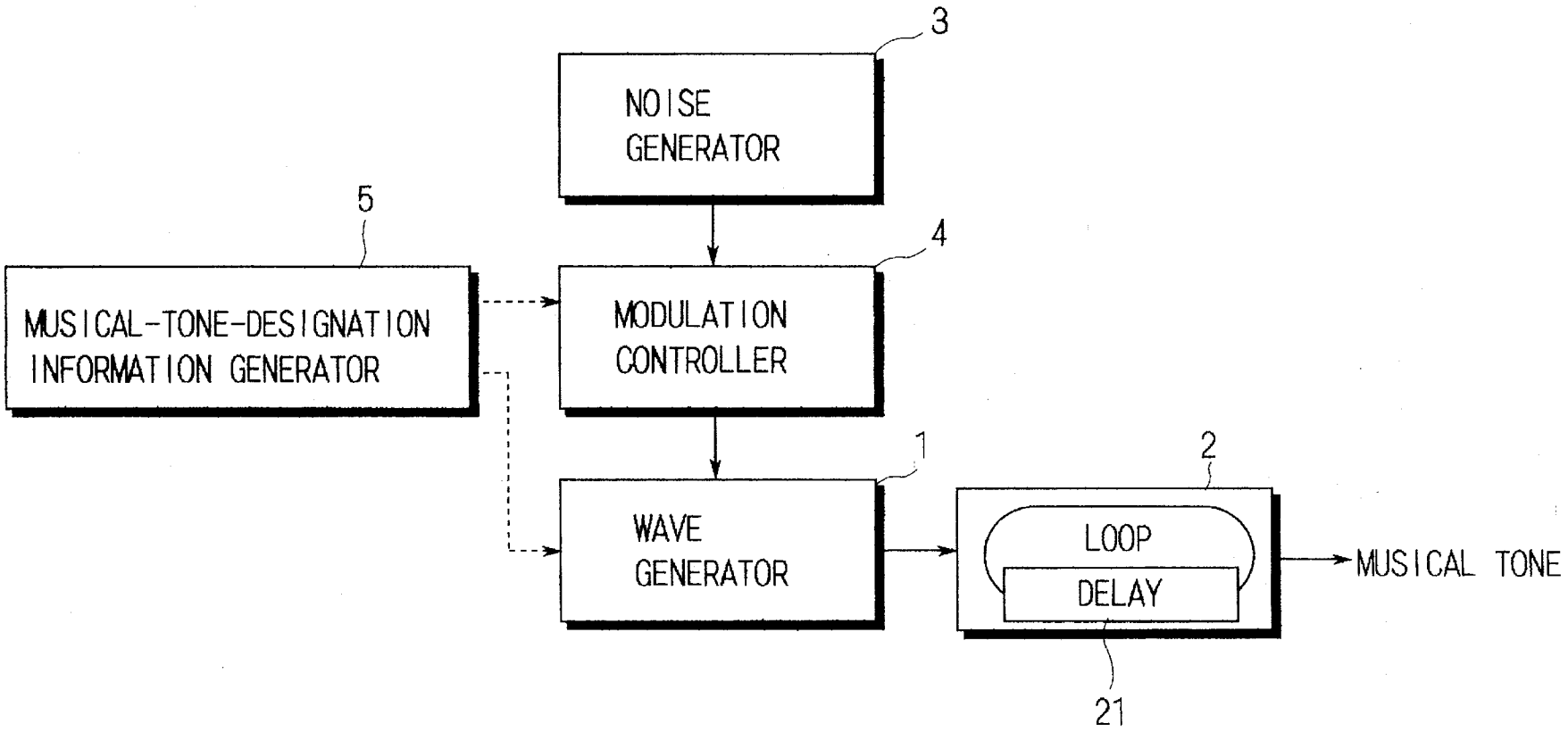
FIG. 1 is a schematic diagram of the present invention.
Figure 2:
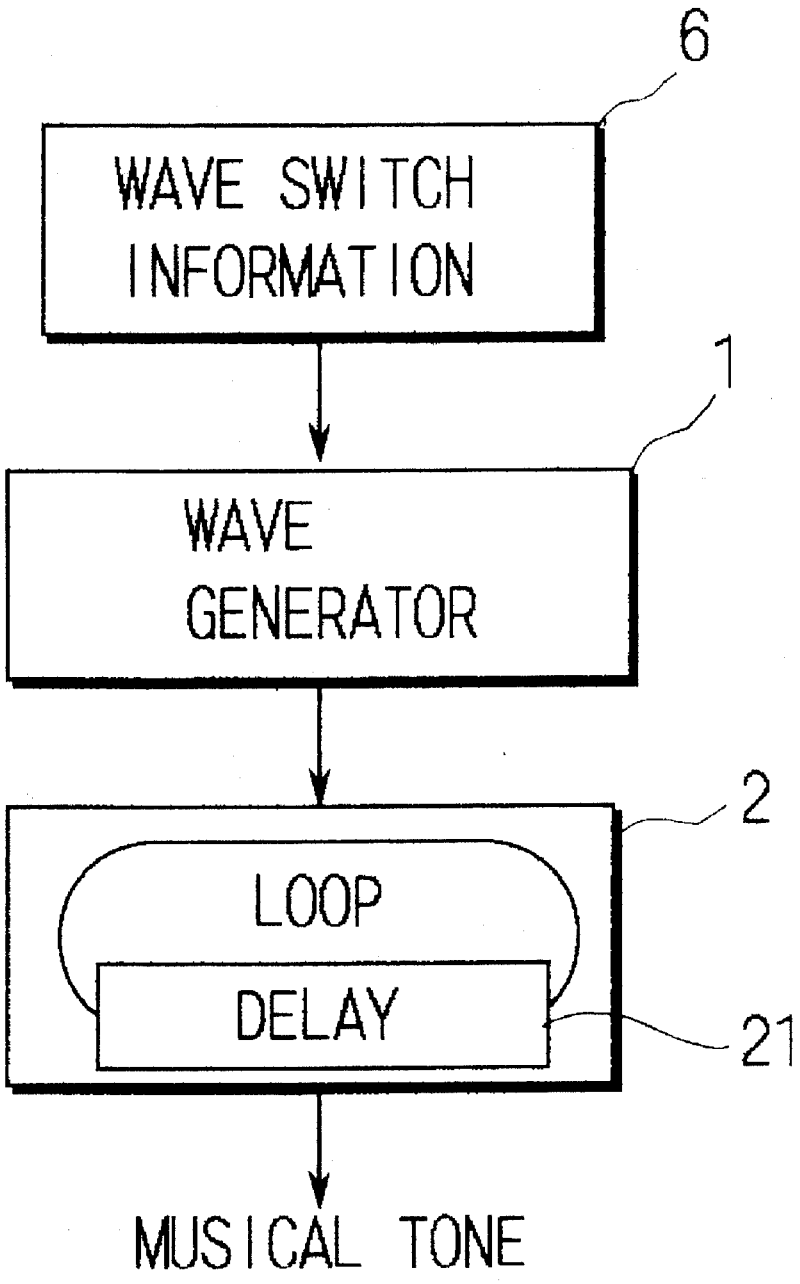
FIG. 2 is another schematic diagram of the present invention.
Figure 3:
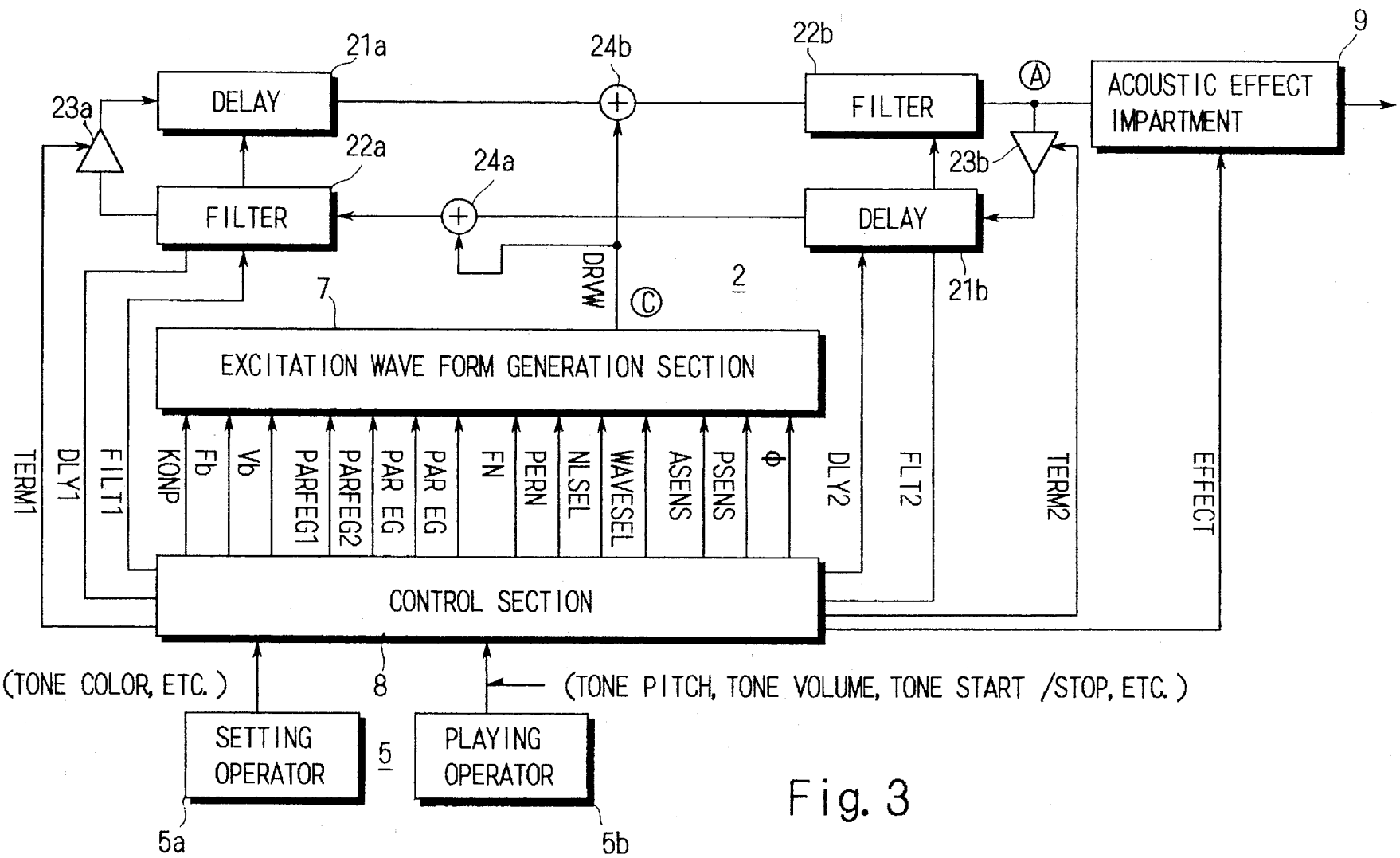
FIG. 3 is a block diagram of an apparatus for synthesizing musical tones embodying the present invention.
Figure 7:
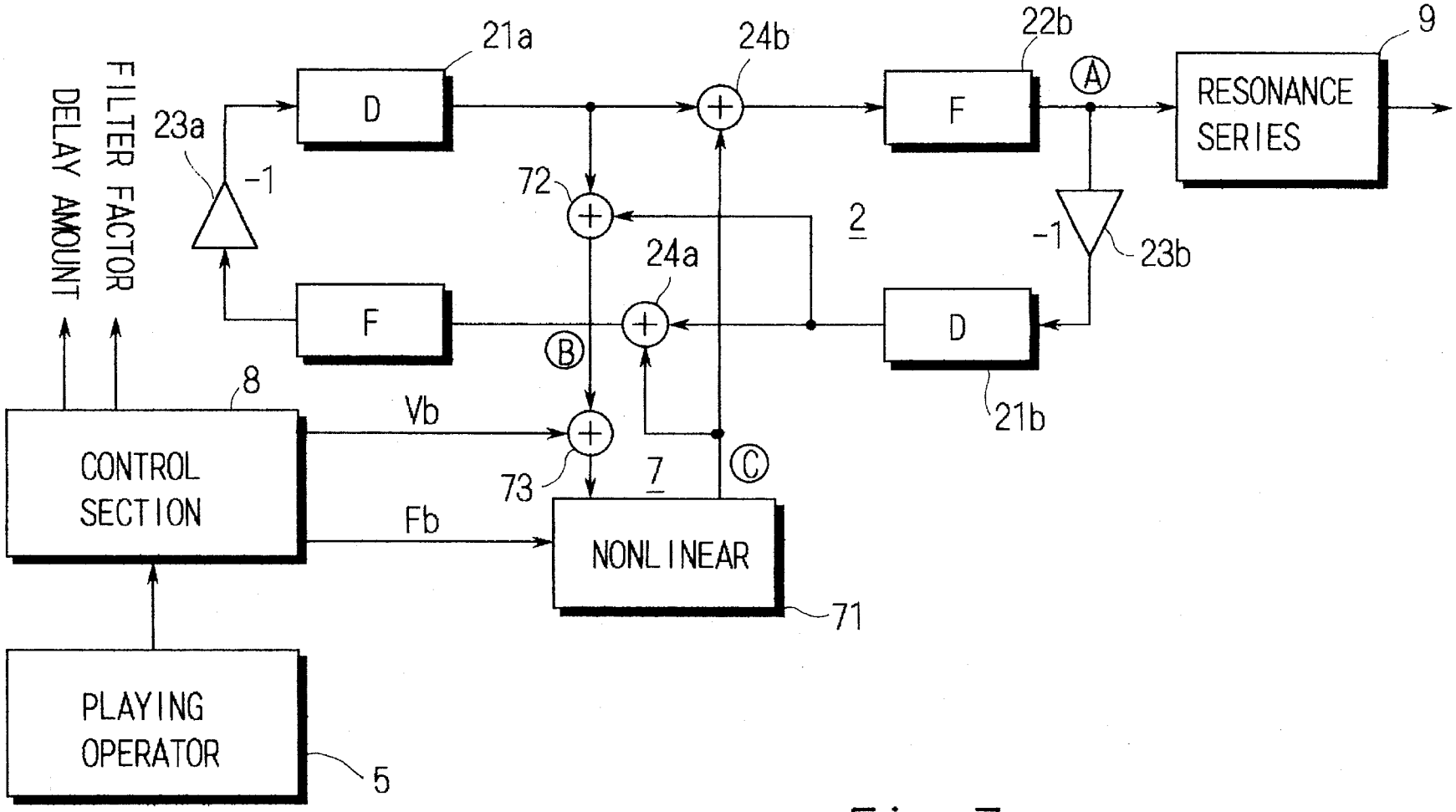
FIG. 7 is a schematic diagram of an apparatus for synthesizing musical tones of a prior art.

FIG. 3 is an organization of an apparatus for synthesizing a musical tone embodying the present invention. The same signs as the conventional apparatus shown in FIG. 7 are also denoted in FIG. 3.

The apparatus in FIG. 3 simulates a string natural instrument, such as a violin, as well as the conventional apparatus. The apparatus is provided with a loop section 2, a musical-tone-designation information section 5, an excitation wave form generator 7, a control section 8, and an acoustic effect imparting section 9.

The loop section 2 is provided with delay circuits 21*a*, 21*b*, filters 22*a*, 22*b*, multipliers 23*a*, 23*b*, and adders 24*a*, 24*b*. The musical-tone-designation information section 5 is provided with a setting operator 5*a* for tone color designation or the like and a playing operator 5*b* for designating a tone pitch, tone volume, and a start and end of tone generation. The loop section 2, the musical-tone-designation information section 5, and the acoustic effect imparting section 9 described later are essentially the same as in FIG. 7.

In FIG. 3, the excitation wave form generator 7 corresponds to the nonlinear series including the nonlinear circuit 71 and the adders 72, 73. The generator 7 generates the same wave form signal as the point "C" in FIG. 7, provided the signal wave form "C" (see FIG. 8) for exciting the loop section 2 is generated based on the signal wave form "B" (see FIG. 8) taken out from the loop section 2 in the apparatus shown in FIG. 7. While, the excitation wave form generator 7 in FIG. 3 generates the signal wave form "C" with an open loop way independent of a signal that circulates in the loop section 2.

Figure 8:
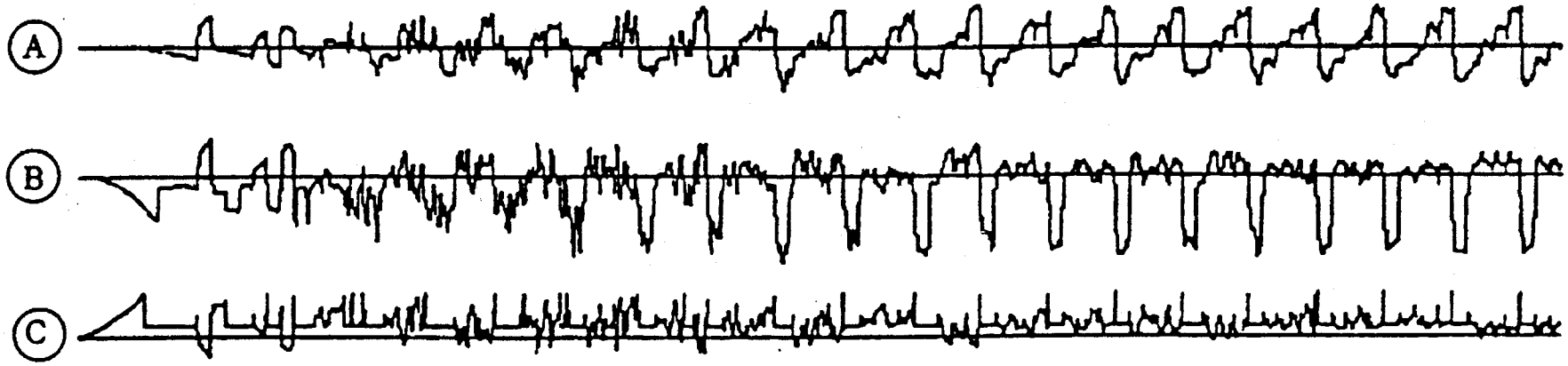
FIG. 8 shows wave form signals at specified points in FIG. 7.

FIG. 8 shows an example of the signal wave forms at an attack portion of a musical tone synthesizing series. Each signal wave form at the point shown by the sign "A", "B", or "C" in FIG. 3 is shown in FIG. 8 by the same sign, respectively.

In the apparatus in FIG. 7, since the wave form at the point "A" corresponds to a vibration wave form at a bridge or a fret of the natural string instrument, the musical tone can be obtained by multiplying the wave form signal at the point "A" by a characteristic of a resonance board of the instrument at the acoustic effect imparting section 9.

In the apparatus in FIG. 3, since the loop circuit 2 is excited by the same wave form signal "C" as FIG. 7, the same wave form as the point "A" in FIG. 7, namely the wave form at the bridge or the fret of the natural string instrument can be observed. Therefore, musical tones of the natural string instruments can be obtained by processing the wave form signal at the acoustic effect imparting section 9 which is characterized by the resonance board.

The control section 8 serves for controlling a whole process of the apparatus. It is configured so that information of delay time DLY1, DLY2, filter factors FILT1, FILT2, and loop-end-terminal-multiplication factors TERM1, TERM2 is supplied to the loop section 2, as well as the control section in FIG. 7, based on designation information of a tone color, a tone pitch, tone volume and a tone generation start and stop which is sent according to operation of the setting operator 5*a* and the playing operator 5*b* in the musical-tone-designation information section 5. Also, it is configured so that information of bow velocity Fb and bow pressure Vb is supplied to the excitation wave form generator 7, and an effect parameter EFFECT is supplied to the effect imparting section 9. Furthermore, it is configured so that various information which is necessary in place of the signal wave form "B" in the apparatus in FIG. 7, for example a key-on pulse KONP specifying a wave form generation start, noise filter parameters PARFEG1, PARFEG2, a noise EG parameter PARNEG, a excitation wave form EG parameter PAREG, a frequency number FN, a read out number PERN, a nonlinear characteristic parameter NLSEL, wave form designation information WAVESEL, a excitation wave form amplitude modulation factor ASENS, a excitation wave form pitch modulation factor PSENS, and a system clock $\phi$, is supplied to the excitation wave form generator 7.

In FIG. 8, the wave form "B" is an input signal to the nonlinear circuit 71 in FIG. 7, which is obtained by adding output signals of specified points in the loop circuit 2 that is a linear series. As shown in FIG. 8, there is a higher random characteristic in the attack portion as the bridge wave form "A", and there are stabilized rectangle wave forms each having a specified duty ratio in the sustain portion. The wave form "C" corresponding to the wave form "B" is generated when the wave form "B" passes on the nonlinear circuit 1.

Figure 4:
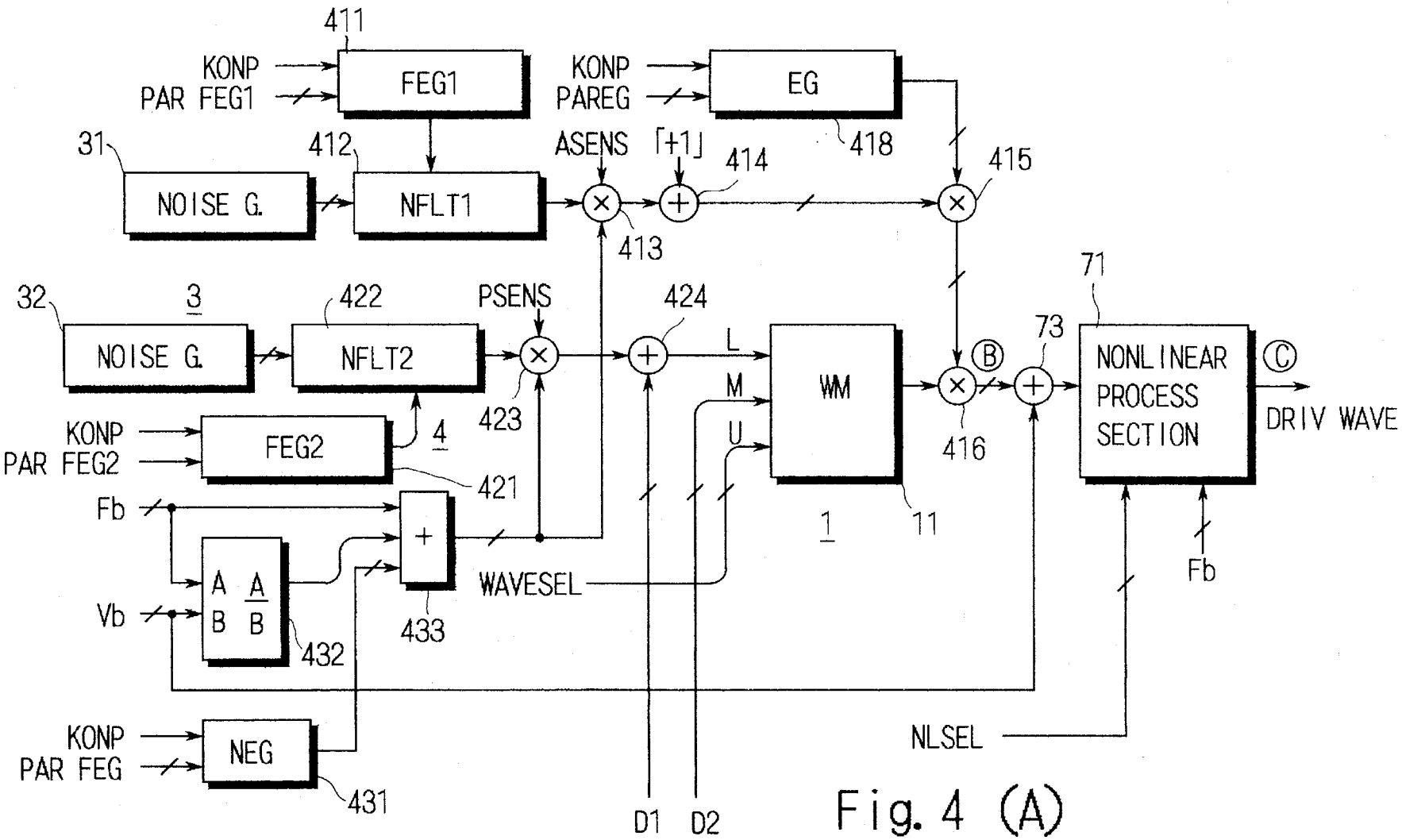
FIG. 4, which is comprised of FIGS. 4(A) and 4(B), is a block diagram of an excitation wave form generator 7.
Figure 4:
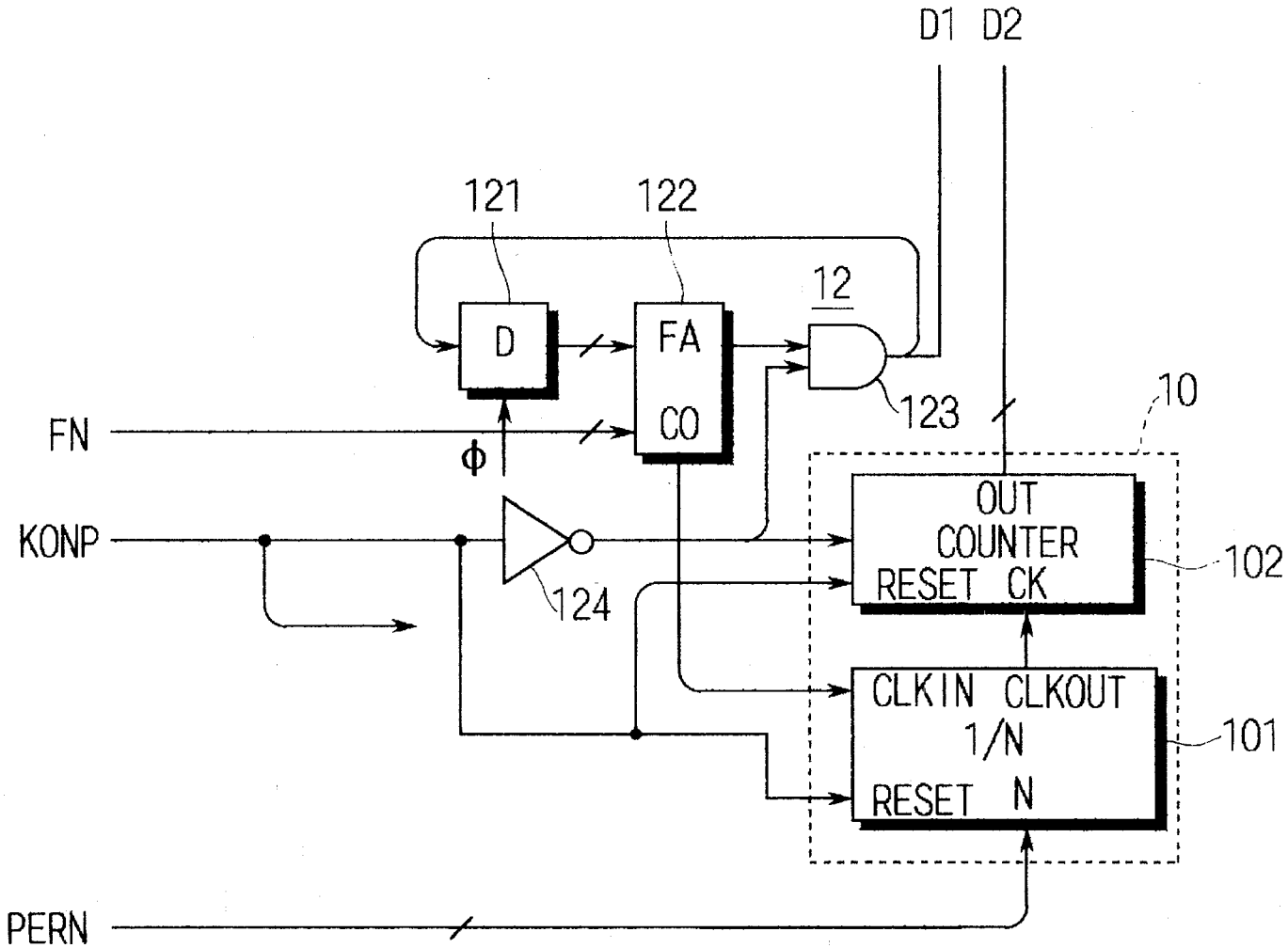

FIG. 4 is an example of the excitation wave form generator 7.

To be a simpler model in control compared with the conventional apparatus, it is the simplest way that the wave form at the point "C" in FIG. 7 is stored in a memory, and the wave form is read from the memory according to a pitch and is inputted into the linear series. However, thus synthesized way causes large memory consumption, and is limited in synthesizing musical tone with a nuance that the natural string instrument has.

Therefore, in FIG. 4, the nonlinear series 71 remains, and a wave form corresponding to the wave form at the point "B" in FIG. 7 is made. The wave form is inputted into the nonlinear series 71 to obtain the same excitation wave form DRVW as the wave form at the point "C". The wave form corresponding to the wave form at the point "B" in FIG. 7 is made so that a basic wave form of that wave form is read from the memory and modulated by noises or the like. This way allows the memory consumption to be decreased more, and causes synthesizing musical tones like the natural string instrument.

In FIG. 4, the excitation wave form generator 7 is provided with a wave form generator 1, a noise generator 3, a modulation control section 4, a wave form switch control section 10 and a nonlinear circuit 71. This type nonlinear circuit is described in some Japanese patent applications in detail, for example Japanese patent application number 1-183329, 1-192708, and 1-194544.

A well known memory tone generator or Frequency Modulation (FM) tone generator can be used as the wave form generator 1. In this example, the tone generator 1 is provided with the wave form memory 11 and a read circuit 12. The wave form memory 11 stores the basic wave form data as Pulse Coded Modulation (PCM) data for one cycle, for each tone color and each lapse time from the attack timing. It is possible that the wave form generator 1 stores the basic wave form data of half cycle, provided the basic wave form data is symmetrical in an amplitude axis and a time axis, as well as the well known wave form memory configuration. It is also possible that the basic wave form data for a plurality of cycles are stored, provided the basic wave form is a wave form which changes complicatedly like the initial attack wave form.

The read circuit 12 is provided with a delay circuit 121, a full adder 122, an AND circuit 123, and an invertor 124. The delay circuit 121 delays input information for one cycle of the system clock $\phi$ which is outputted from the control section 8 in FIG. 3. The full adder 122 adds the output information from the delay circuit 121 to a frequency number FN which is outputted from the control section 8. The AND circuit 123 is connected between the output terminal of the full adder 122 and the input terminal of the delay circuit 121. The invertor 124 inverts the key-on pulse KONP which is outputted from the control section 8 and outputted it to the AND circuit 123. The read circuit 12 accumulates the frequency number FN which is supplied from the control section 8, and the integer part of the accumulated value is outputted to the wave form memory 11 as lower bits address information through the adder 424 of the modulation control section 4. Furthermore, the read circuit 12 supplies the carry signal C0, which is generated for every overflow timing of the accumulated value, i.e., for every timing when one cycle wave form is read from the wave form memory 11, to the wave form switch control section 10.

The accumulated value of the read circuit 12 is cleared, when the key-on pulse KONP is outputted from the control section 8, by adding the L level signal which is inverted by the invertor 124 to another terminal of the AND circuit 123.

The wave form switch control section 10 is provided with a frequency divider 101 and a counter 102. The frequency divider 101 serves for dividing the carrier signal C0 into l/N, where the carrier signal C0 is supplied from the read circuit 12, and the N is dividing information which equals the cycle times information PERN supplied from the control section 8. The counter 102 serves for counting the divided output of the frequency divider 101. The counted value of the counter 102 is supplied to the wave form memory 11 as intermediate bits address information. The frequency divider 101 and the counter 102 are reset by the key-on pulse KONP which is outputted from the control section 8, respectively.

The lower bits address information supplied to the wave form memory 11 is outputted from the read circuit 12, and the intermediate bits address information is outputted from the wave form switch control section 10. The upper bits address information is outputted from the control section 8 as wave form designation information WAVESEL for designating a tone color. Therefore, the basic wave form is read basically as a wave form whose frequency corresponds to the frequency number FN according to the counting output of the read circuit 12. The main tone color is designated by the wave form designation information WAVESEL. Also, the tone color which varies depending on the lapse time after the generation of the key-on pulse KONP is designated by the output value of the wave form switch control section 10.

In the circuit of FIG. 4, each basic wave form corresponding to the tone color which varies depending on the lapse time is read successively for each cycles corresponding to the read out times information PERN (=frequency dividing rate N).

If the wave forms in the wave form memory consist of only sustainlike wave forms, the wave form switch control section 10 is not needed. Each of the noise generators 31, 32 in the noise generator 3 includes a known random number generator.

In FIG. 4, the result of multiplying (amplitude modulation) of the basic wave form from the wave form memory 11 and the amplitude signal corresponds to the wave format the point "B" in FIG. 7 (the wave form "B" in FIG. 8). Thus modified basic wave form causes random ingredients in the attack portion. The envelope generator 431 serves for generating the attack wave form and gating the random signals. The output signals, a (bow pressure: Fb)/(bow velocity: Vb) outputted from a divider 432, and the bow pressure Fb are added by the adder 433. That's why the actual phenomenon in the natural instrument is such that if the Fb value is larger and the Fb value is relatively larger than the Vb value the random ingredients increase.

The filter factor generators 411, 412 in the modulation control section 4 are reset by the key-on pulse KONP which is supplied from the control section 8, respectively. Furthermore, it generates filter factors for controlling the characteristics of the filters 412, 412 according to the noise filter parameters PARFEG1, PARFEG2 which are outputted from the control section 8. The frequency band to be passed of the noise (random) signals outputted from the noise generators 31, 32 is limited appropriately by the filters 411, 412 for imparting a desired frequency characteristic to the signals. A low pass filter or a high pass filter can be used as the filters.

The noise signals given the desired frequency characteristic after they are generated at the noise generator 31 are outputted to the multiplier 413 for gating based on the output of the adder 433. The adder 414 adds "+1" to the output of the multiplier 413 so that every amplitude ingredient is plus one. The adder 415 adds the amplitude envelope outputted from the envelope generator 418 to the output of the adder 414, and the added result is inputted into a multiplier 416 to multiply the basic wave form by the added result. Therefore, the basic wave form is amplitude modulated by the noise signal which is supplied through the multiplier 415.

While, the noise signal given the desired frequency characteristic by the filter 422, is gated based on the output of the adder 433 by the multiplier 423. After that, the output of the multiplier 423 is inputted into the adder 424 for adding it to the lower bits address information to the wave form memory 11. Therefore, the basic wave form is modulated toward the time axis by the noise signal supplied through the multiplier 423.

The envelope generators 418, 431 are of course triggered by a key-on and a key-off. Also, an attack level and a sustain level and so on are modified by an initial touch, an after touch or the other operator's information. It is possible that the noise filter parameters PARFEG1, PARFEG2 are generated by specialized envelope generators each of which is provided for each filter.

According to the wave form "B" in FIG. 8, the necessary random ingredients are relatively rough at the beginning of the attack portion, i.e., the lower side cut off frequency is lower, therefore the frequency band being narrow. The random ingredients become small gradually, i.e., the higher side cut off frequency is higher, therefore the frequency band being wider. The control section 3 and the filter factor generators 411, 412 are arranged so as to control the cut off frequencies of the filters 411, 412 in time.

The above described embodiment is formed so that the read out times PERN is constant in time. It is possible to vary the read out times in time or for every basic wave form.

Figure 5:
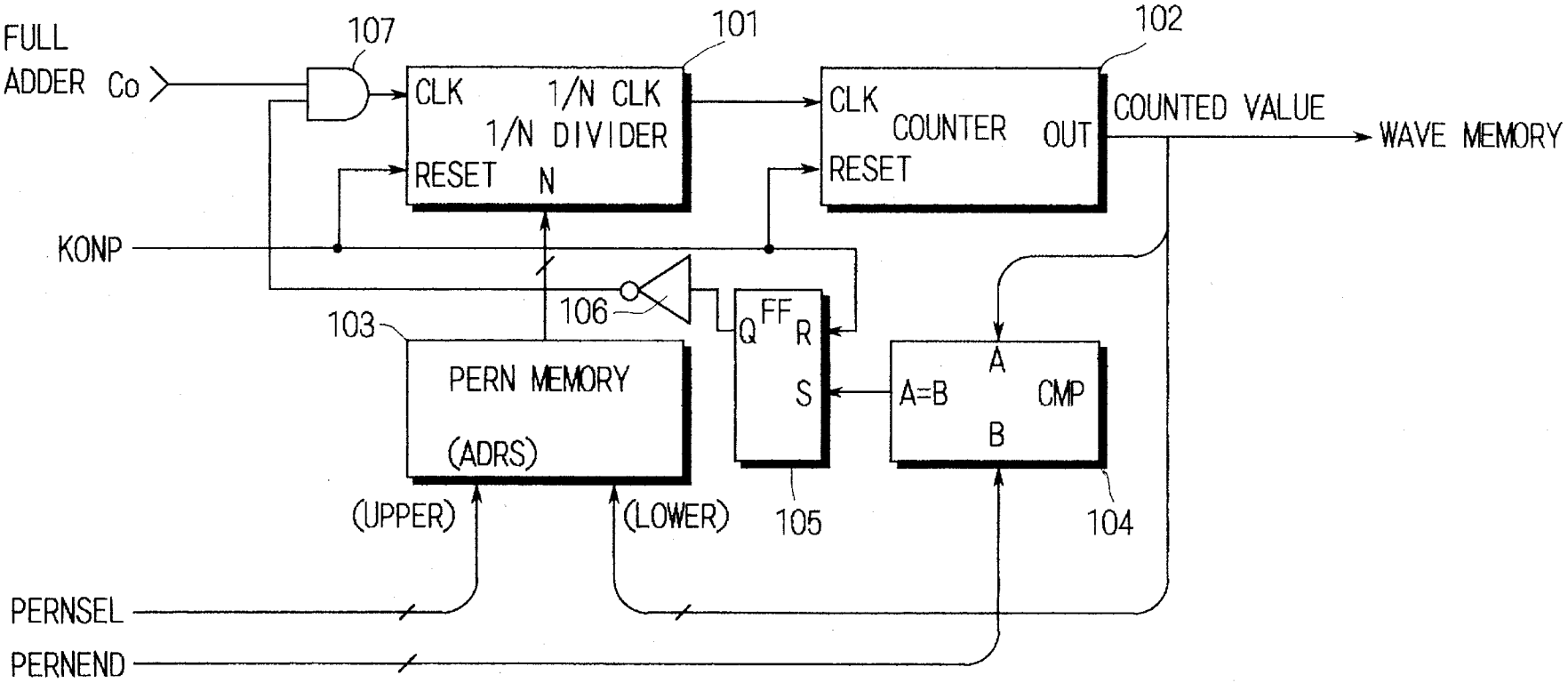
FIG. 5 is a block diagram of an example of a wave form switch control section.

FIG. 5 shows an example of the wave form switch control section for designating the read out times for each wave form. The wave form switch control section includes a PERN memory 103, a comparator 104, a flip flop 105, an invertor 106 and an AND circuit 107, to add to the whole circuit in FIG. 4. The control section 8 outputs specified information PERNSEL, in place of the read out times information PERN, for designating an area of the PERN memory 103 according to tone color information, and specified information PERNEND representing the number of basic wave forms to be read out successively according to the tone color information or the like.

FIG. 6 shows a format of the PERN memory 103. The memory stores the read out times, i.e., dividing rate information, N00, N01, . . . N07, N10, N11, . . . N17, . . . , in each memory address of each memory area designated by the information PERNSEL.

In the wave form switch control section, if the key-on pulse KONP is supplied from the control section 8, the frequency divider 101 and the counter 102 are reset, and the flip flop 105 also is reset. Then the output terminal "Q" of the flip flop 105 becomes an L level, the L level being inverted by the invertor 106 and the inverted level being inputted into an input terminal of the AND circuit 107. Therefore, the carrier signal C0 supplied from the read circuit 12 is imparted to the frequency divider 101 through the AND circuit 107, and the divided output of the frequency divider 101 is counted by the counter 102. This counted output data is imparted to the wave form memory 11 as the intermediate bits address information as well as in FIG. 4. Also, the counted output data is imparted to an input terminal of the comparator 104 and to lower bits address terminals of the PERN memory 103.

The area designation information PERNSEL from the control portion 8 is imparted to the upper bits address terminals of the PERN memory 103. The information group of the frequency dividing rates, Nn0, Nn1, . . . Nn7, each of which corresponds to a designated tone color, is decided by the area designation information PERNSEL (=n). The counted value output data of the counter 102 is "0" immediately after the key-on pulse KONP is generated, i.e., at the attack beginning timing, the data "0" being imparted to the lower bits address terminals of the PERN memory 103. Therefore, first, the frequency dividing rate information Nn0 is read from the PERN memory 103 and imparted to the divider 101. The read circuit 12 generates the carrier signal C0 every time when the basic wave form for one cycle is read from the wave form memory 11. The divider 101 generates divided output when the basic wave forms for Nn0 cycles are read from the wave form memory 11 and the Nn0 carrier signals are outputted from the read circuit 12. The counter 102 counts the divided output and outputs the counted value "1". Then the next basic wave form is read from the wave form memory 12, and the next dividing rate information Nn1 is read from the PERN memory 103. In this manner, the basic wave forms successively are read by cycles of Nn0, Nn1, . . . .

When the counted value reaches the information PERNEND which is final counted value in successively reading from the PERN memory 103, the comparator 104 outputs a coincide signal and the signal is imparted to the set terminal "S" of the flip flop 105. Therefore, the output terminal "Q" of the flip flop 105 becomes to a high level. The high level is inverted by the invertor 106 and the inverted level is inputted into an input terminal of the AND circuit 107 to make the AND circuit open. It is inhibited that the carrier signal C0 from the read circuit 12 is inputted into the divider 101. That causes the stop of the divider 101, so that the increment of the counted value, i.e., the intermediate bits address of the wave form memory 12, is stopped.

It is possible to modify the above described embodiment according to the subject of the present invention. For example, the FM synthesizing manner can be applied to the wave form generator in place of the PCM manner of the above embodiment. In this case, it is possible that the random characteristic of the above embodiment applies to operators of the FM tone generator.

The pitch frequency is decided by a ΔF which is added to the PG. The ΔF returns a value that a desired pitch frequency is divided by a sampling frequency. In case of a vibrato and a pitch-bend, the ΔF is shifted at an appropriate rate. The total amount of the delay of the linear series is set to a value that the sampling frequency is divided by the desired pitch frequency, a less value than that value, or a value by integer times.

The above mentioned embodiment is described about the synthesizing apparatus having a function of generating the string's tone color. The present invention allows any tone color other than the string's tone color or a new tone color to be synthesized by setting the various control information and parameters in the same configuration. Furthermore, the nonlinear circuit portion 71 can be organized by a prior circuit and the circuit the applicant describes in the specifications of the Japanese patent application number 1-192708 and 1-292257.

Figure 9:
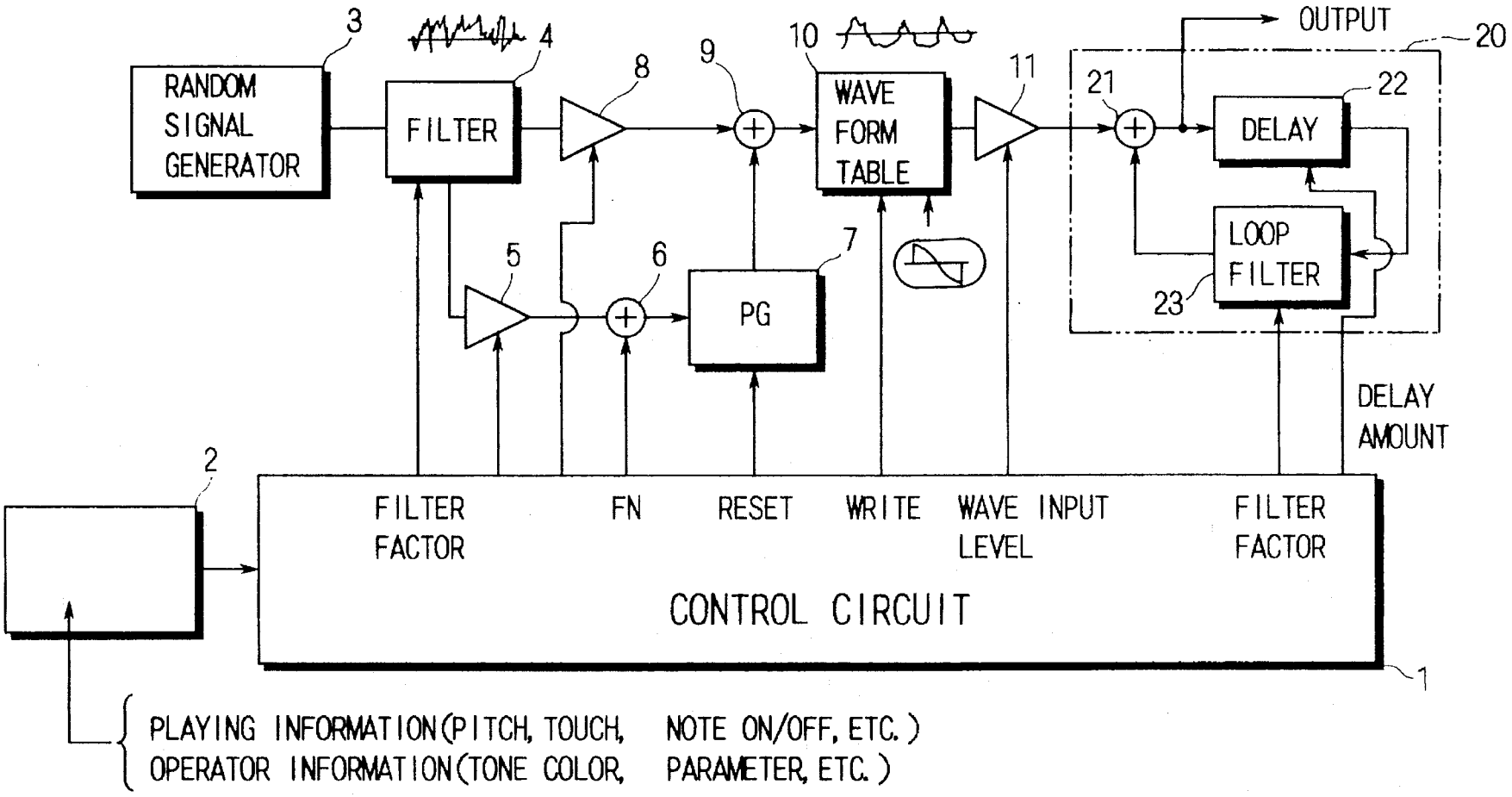
FIG. 9 is a block diagram of another apparatus for synthesizing musical tones embodying the present invention.

FIG. 9 is a block diagram of a musical tone signal generation apparatus which is another embodiment of the present invention. This apparatus can be applied to an electronic musical instrument. A control circuit 1 is organized by a microprocessor or the like. The circuit serves for controlling various control signals based on input signals from an input device 2. The input device 2 is a keyboard or the like. Information inputted to the control circuit 1 from the input device 1 is a tone pitch, touch data, note on/off data, tone color selection data, parameter setting data or the like. The musical tone signal generation apparatus is provided with a delay feedback circuit 20, a wave form table 10, a phrase generator 7, and a random signal generator 3. A random signal generated by the random signal generator 3 is inputted into amplifiers 5, 8 through a filter 4. Gains of the amplifiers 5, 8 are controlled by a gain control signal of the control circuit 1. An output signal of the amplifier 5 is inputted into an adder 6. A frequency number FN is inputted into the adder 6 from the control circuit 1. The frequency number corresponds to a tone pitch and is a numerical value which increase as a tone pitch becomes high. Therefore, the output of the adder 6 becomes a frequency number FN which is modulated by the random signal. The output of the adder 6 is inputted into the phrase generator 7. The phrase generator 7 accumulates the inputted frequency number FN and outputs a phrase signal as an address signal. The outputted address signal is inputted into an adder 9, while the output of the amplifier 8 is also inputted into the adder 9. Thereby, the output of the adder 9 becomes a phrase signal to which the random signal is added. This phrase signal is inputted into the wave form table 10. At the wave form table 10, a basic wave form signal is read according to the input phrase signal (address signal). In the wave form table, a wave form signal for one cycle is stored for every tone color. The wave form signal to be read is selected by the control signal of the control circuit 1. The level of the read basic wave form signal is controlled by an amplifier 11 and the level controlled signal is inputted into an adder 21 of the delay feedback circuit 20.

At the delay feedback circuit 20, the basic wave form signal inputted into the adder 21 is delayed for a specified time by a delay circuit 22, and the delayed signal is returned again to the adder 21 through a loop filter 23. The loop filter 23 has a function of control of the rate between a newly inputted basic wave form signal from the wave form table 10 and the returned (feedback) signal. The delay amount of the delay circuit 22 and the filter characteristic of the loop filter 23 can be varied by the control signal inputted from the control circuit 1. The musical tone signal of the apparatus is outputted from the output of the adder 21.

In the present embodiment, the random signal that the random signal generator 3 generated is imparted to both of an input side and an output side of the phrase generator 7. It is possible that either gain of the amplifiers 5, 8 is "0" so that the random signal is inputted to either of the input side or the output side of the phrase generator 7. The modulation of the frequency number FN by the output of the amplifier 5 causes an FM modulation to the phrase signal, while the modulation of the phrase signal by the output of the amplifier 8 causes an AM modulation to the phrase signal. An access to the wave form memory by thus modulated phrase signal allows the read wave form signal to change into a various wave form signal, even though the read wave form is monotonous.

The filter 4 for the random signal can be omitted. In the present embodiment, the phrase signal is obtained by an accumulation of the frequency number, and a cyclic wave form is accessed by the variable phrase signal at the wave form table 10. Instead of the method, it is possible to read the wave form signal by a fixed phrase signal as a decay tone color. In case of employment of the fixed phrase signal, a filter to limit an access area of the wave form table 10 is required. An FM modulation signal generator can be used instead of the random signal generator, if the wave form cycle of the FM modulation signal is enough wider. A modulation level, an input signal level to the random filter 4 or a characteristic of the random filter 4 can be varied by inputted playing information. That is, a key-scalling method can be employed.

What is claimed is:

1. An apparatus for synthesizing a musical tone comprising:

loop circuit means, including delay means, for circulating an input wave form signal through the delay means;

means for generating a random signal;

wave form generation means for generating a wave form signal to be input into the loop circuit means, the wave form generating means including modulation means for modulating the wave form signal in response to the random signal to control the frequency spectrum of the wave form signal, wherein the modulated wave form signal is input to the loop circuit means as the input wave form signal; and output means for outputting a signal circulated in the loop circuit means as a musical tone signal.

2. An apparatus for synthesizing a musical tone according to claim 1, further comprising nonlinear circuit means for nonlinear processing said wave form signal modulated by said modulation means and inputting the nonlinear-processed wave form signal into said loop circuit means.

3. An apparatus for synthesizing a musical tone according to claim 1, said wave form generation means generates said wave form signal independent of said circulated signal.

4. An apparatus for synthesizing a musical tone according to claim 1, wherein said means for generating a random signal includes noise generating means for generating a noise signal as said random signal.

5. An apparatus for synthesizing a musical tone according to claim 1, said random modulation means includes first filter means for filtering said random signal to impart a specified frequency characteristic thereto.

6. An apparatus for synthesizing a musical tone comprising:

loop circuit means, including delay means, for circulating an input wave form signal through the delay means;

wave form generation means for providing a wave form signal;

random modulation means for modulating the wave form signal, said random modulation means including first filter means for filtering a first noise signal to impart a first specified frequency characteristic thereto, and second filter means for filtering a second noise signal to impart a second specified frequency characteristic thereto, said random modulation means modulating the wave form signal to be input to the loop circuit means in accordance with the filtered first and second noise signals; and output means for outputting a signal circulated in the loop circuit means as a musical tone signal.

7. An apparatus for synthesizing a musical tone according to claim 1, said wave form generation means comprising a wave form memory means for storing wave form data and read means for reading out the wave form data from the wave form memory means in accordance with address data.

8. An apparatus for synthesizing a musical tone according to claim 7, said random modulation means includes noise generating means for generating a noise signal as said random signal which modulates said address data outputted from said reading means.

9. An apparatus for synthesizing a musical tone according to claim 8, said random modulation means includes first filter means for filtering said noise signal to impart a specified frequency characteristic thereto.

10. An apparatus for synthesizing a musical tone comprising:

loop circuit means, including delay means, for circulating an input wave form signal through the delay means;

wave form generation means for generating a wave form signal to be input into the loop circuit means, said wave form generation means comprising a wave form memory means for storing wave form data and read means for reading out the wave form data from the wave form memory means in accordance with address data;

random modulation means for modulating the wave form signal generated by the wave form generation means based on a random signal, wherein said random modulation means includes noise generating means for generating a noise signal as said random signal which modulates said address data output from said reading means, and filter means for filtering said noise signal to impart a specified frequency characteristic thereto; and output means for outputting a signal circulated in the loop circuit means as a musical tone signal.

11. An apparatus for synthesizing a musical tone comprising:

loop circuit means, including delay means, for circulating an input wave form signal through the delay means;

wave form generation means for generating a wave form signal to be inputted into the loop circuit means, said wave form generation means comprising a wave form memory means for storing wave form data and read means for reading out the wave form data from the wave form memory means in accordance with address data;

random modulation means for modulating the wave form signal generated by the wave form generation means based on a random signal; and output means for outputting a signal circulated in the loop circuit means as a musical tone signal, said read means including wave form switch means for switching said wave form data to be read successively with time.

12. An apparatus for synthesizing a musical tone according to claim 11, said read means includes read times varying means for varying read times of the same wave form data for one cycle before being switched to a next wave form data by said wave form switch means.

13. An apparatus for synthesizing a musical tone according to claim 12, said read times varying means includes read times memory means for storing said read times of the same wave form data for each predetermined wave form data.

14. An apparatus for synthesizing a musical tone according to claim 1, further comprising musical tone information input means for inputting musical tone information which controls generation of said wave form signal and modulation of said wave form signal.

15. An apparatus for synthesizing a musical tone according to claim 14, said musical tone information includes a tone pitch, a tone color, tone volume, tone generation start timing, and tone generation stop timing.

16. An apparatus for synthesizing a musical tone according to claim 7, said wave form data is pulse coded modulation data.

17. An apparatus for synthesizing a musical tone comprising:

wave form switch data generation means for generating wave form switch data successively with time;

wave form generation means for generating wave form signals successively each of which is different from each other according to the wave form switch data; and loop circuit means, including delay means, for circulating the wave form signals generated by the wave form generation means and outputting the circulated wave form signals as a musical tone signal.

18. An apparatus for synthesizing a musical tone according to claim 17, each cycle of said wave form signals is different from each other, and said wave form switch data includes a kind of a wave form signal to be generated and cycle times for the kind of wave form signal to be generated.

19. An apparatus for synthesizing a musical tone according to claim 18, said cycle times is varied according to said kind of the wave form signal to be generated.

20. An apparatus for synthesizing a musical tone according to claim 7, said read means includes phrase generation means for generating a phrase signal based on a frequency number signal, which is imparted to said wave form memory means as address data.

21. An apparatus for synthesizing a musical tone according to claim 20, said random modulation means includes random signal generation means for generating a random signal which modulates said frequency number signal.

22. An apparatus for synthesizing a musical tone according to claim 20, said random modulation means includes random signal generation means for generating a random signal which modulates said phrase signal.

23. An apparatus according to claim 6, wherein said wave form generation means includes a wave form memory for storing at least one predetermined wave form, and means for reading the wave form memory to provide a wave form signal to be input to the loop circuit means, wherein the first filtered noise signal modulates the reading of the wave form memory, and the second filtered noise signal modulates the wave form read from the wave form memory.

* * * * *